US007207863B2

(12) United States Patent
Miyazawa

(10) Patent No.: US 7,207,863 B2
(45) Date of Patent: Apr. 24, 2007

(54) ASPHERIC-SURFACE PROCESSING METHOD AND ASPHERIC-SURFACE FORMING METHOD

(75) Inventor: Makoto Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/220,610

(22) Filed: Sep. 8, 2005

(65) Prior Publication Data

US 2006/0003674 A1 Jan. 5, 2006

Related U.S. Application Data

(62) Division of application No. 10/779,867, filed on Feb. 18, 2004, now Pat. No. 7,070,474.

(30) Foreign Application Priority Data

Feb. 21, 2003 (JP) ..... 2003-044362
May 16, 2003 (JP) ..... 2003-139200
Sep. 3, 2003 (JP) ..... 2003-311407

(51) Int. Cl.
*B24B 49/00* (2006.01)

(52) U.S. Cl. ..... 451/5; 451/42; 451/57

(58) Field of Classification Search ..... 451/5, 451/42, 43, 54, 57, 58
See application file for complete search history.

(56) References Cited

U.S. PATENT DOCUMENTS 5,485,771 A 1/1996 Brennan et al.
6,602,110 B2 * 8/2003 Yi et al. ..... 451/9
6,887,405 B2 * 5/2005 Tohara et al. ..... 264/2.5
2002/0160690 A1 * 10/2002 Miyazawa et al. ..... 451/5

FOREIGN PATENT DOCUMENTS

| | | |
|---|---|---|
| EP | 0 849 038 A2 | 6/1998 |
| JP | 05-237702 A | 9/1993 |
| JP | 10-175149 A | 6/1998 |
| JP | 11-309602 A | 11/1999 |
| JP | 2002-283204 A | 10/2002 |
| JP | 2003-053602 A | 2/2003 |
| WO | WO 02/37168 A2 | 5/2002 |

* cited by examiner

*Primary Examiner*—Dung Van Nguyen
(74) *Attorney, Agent, or Firm*—Sughrue Mion, PLLC

(57) ABSTRACT

An aspheric-surface processing method according to the present invention, uses a cuffing apparatus including at least one turning tool movable in the same direction as the rotating axis of the work and is also movable in a direction perpendicular to the rotating axis of the work. This method includes moving the turning tool at a predetermined feed pitch in a fixed direction over at least a part of the work region extending from the center of the rotating axis of the work to a peripheral portion of the work and also moving the turning tool in another direction perpendicular to the rotating axis of the work in order to process the work for forming an axis-asymmetric aspheric surface.

5 Claims, 9 Drawing Sheets

ASPHERIC-SURFACE PROCESSING METHOD AND ASPHERIC-SURFACE FORMING METHOD

CROSS REFERENCE TO RELATED APPLICATIONS

This is a Divisional Application of U.S. application Ser. No. 10/779,867 filed Feb. 18, 2004 now U.S. Pat. No. 7,070,474. The entire disclosure of the prior application, application Ser. No. 10/779,867 is hereby incorporated by reference.

BACKGROUND OF THE INVENTION

1. Field of the Invention

The present invention relates to aspheric-surface processing methods, and more specifically, to an aspheric-surface processing method for quickly cutting an aspheric surface having a large undulation and an aspheric-surface forming method.

This application is based on Japanese Patent Applications Nos. 2003-044362, 2003-139200, 2003-311407 filed on Feb. 21, 2003, May 16, 2003 and Sep. 3, 2003, respectively, the disclosures of which are incorporated herein by reference in their entirety.

2. Description of Related Art

A progressive dioptric lens without a so-called boundary is often used as a presbyopia-corrective eyeglass lens. In recent years, a so-called inner-surface progressive lens having a concave surface close to an eyeball, formed in a curved surface combined with a progressive surface or a progressive toric surface has been proposed. The inner-surface progressive lens has a drastically improved optical performance by reducing waviness and strain which are drawbacks of the progressive dioptric lens.

Japanese Unexaminer Patent Applications Publication No.s 11-309602, 10-175149 and 2002-283204 provide prior-art literature information related to techniques for generating an axis-asymmetric aspheric surface such as a progressive concave surface of such an eyeglass lens. All of the above mentioned publications are incorporated herein by reference for their helpful background information on previous attempts to generate an aspheric surface quickly and accurately.

A tri-axial control, numerically-controlled cutting apparatus for generating an axis-asymmetric aspheric surface continuously positions a turning tool at predetermined positions with an X-axis table, Y-axis table, and work-axis rotating means, serving as a three-axes positioning mechanism. The numerically controlled cutting apparatus generates a configuration of a lens by cutting the lens in accordance with a design configuration of the lens. A general control method of the cutting apparatus lies in that rotational positions of a work are detected by an encoder while the work is being rotated, and the X-axis table, the Y-axis table, and the work-axis rotating means serving as the three-axes positioning mechanism are controlled in synchronization with the rotational positions.

A normal-control processing method serving as a known configuration-generating control method using the numerically-controlled cutting apparatus will be described with reference to FIGS. 8 to 10. FIG. 8 is a schematic view illustrating a work surface of a lens to be processed in accordance with the normal-control processing method, wherein FIG. 8(*a*) is an elevation view of the lens, and FIG. 8(*b*) is a sectional view of the lens taken along the line B–B' indicated in FIG. 8(*a*). FIG. 9 is a conceptual view illustrating the normal-control processing method. FIG. 10 is a conceptual view illustrating center positions of a turning tool in the X-direction to be processed in accordance with the normal-control processing method.

Numerical data for an NC control of the normal-control processing method will be described using an arbitrary position Qx shown in FIG. 8(*a*). When a helix extending at a feed pitch P from the periphery to the center of rotation of a round lens is assumed, the numerical data for the NC control of the normal-control processing method is given by three-dimensional coordinated values (θ, Rx, y) indicating a work position of the lens, wherein θ and Rx are a rotational angle and a distance from the center of rotation of the lens (i.e., a radius of the lens), respectively, providing two-dimensional coordinate values of each of intersections between the helix and radial lines extending from the center of rotation of the lens at a predetermined angle, and y (not shown) is a height of each intersection in accordance with the surface configuration in the Y-direction.

A toric surface of the lens is defined as a curved surface having a curve (a base curve) with the minimum curvature of radius, extending along the line A–A' and another curve (a cross curve) with the maximum curvature of radius, extending along the line B–B' perpendicular to the line A–A', both lines illustrated in FIG. 8(*a*). When a difference in the curvatures of the radius of the base curve and the cross curve is great, as shown in FIG. 8(*b*), a cross-section of the lens cut along the cross curve has a curved configuration having very thick ends and a thin central part.

A turning tool 325, shown in FIG. 9, performs a reciprocating motion between the thinnest portion and the thickest portion of the lens once every 90-degrees of rotation. That is, the turning tool 325 performs a reciprocating motion in the Y-direction. For example, when the lens rotates by 90 degrees from an A–A' cross-section to a B–B' cross-section as shown in FIG. 9, the turning tool 325 moves towards the positive side of the Y-axis, from an arbitrary work position Qn at the thinnest portion to an arbitrary work position Qnm at the thickest portion.

The tip of the turning tool 325 for cutting the lens has a cross-section of an arch-shape (hereinafter, referred to as a curved shape). In accordance with the normal-control processing method, for example, the center of the curved portion of the tip of the turning tool 325 is positioned along a line being normal to the base curve of the lens and extending through the work position Qn of the lens.

More particularly, at the arbitrary work position Qn of the thinnest portion (the base curve of the A–A' cross-section), a center position Pn of the turning tool 325 is positioned along the line being normal to the base curve of the lens and extending through the work position Qn. At an arbitrary work position Qnm of the thickest portion (the cross curve of the B–B' cross-section) where the lens is rotated by 90 degrees from the work position Qn, a center position Pnm of the turning tool 325 is positioned along a line being normal to the cross curve and extending through the work position Qnm. The work position Qnm moves towards the center of the lens in the X-axis direction by a quarter of the feed pitch P from the work position Qn. When moving from the work position Qn to the work position Qnm, the turning tool 325 moves towards the positive side of the Y-axis direction by ΔY while moving relative to the work towards the center of the lens in the X-axis direction by Xm.

At an arbitrary work position Qnr of the thinnest portion (the base curve of the A–A' cross-section) where the lens is further rotated by 90 degrees as shown in FIG. 10, the turning tool 325 moves towards the negative side of the Y-axis direction, not shown. In this case, with respect to the X-axis direction, since an outward speed of the turning tool 325 due to a decrease in depth of the lens is greater than a feed rate of the turning tool 325 towards the center of the lens, the turning tool 325 moves relative to the work towards the periphery of the lens by Xr as shown in FIG. 10.

That is, the cross curve of the B–B' cross-section serves as a reverse point between positive and negative signs in the moving direction of the turning tool 325; hence, the turning tool 325 moves in the positive and negative directions in an alternating manner with the cross curve of the B–B' cross-section as a boundary and performs a reciprocating motion in the X-axis and Y-axis directions.

In accordance with the processing method by means of the normal control, as shown in FIGS. 8–10, intersections between the helix and the radial lines provide work positions, and the cutting apparatus is controlled such that the center position of the tip of the turning tool is positioned along a line being normal to a work surface of the work and extending through the work position. That is, in accordance with the processing method by means of the normal control, a turning tool cuts a work while repeatedly moving in the positive and negative directions in an alternating manner, as described above, and depicting a complicated helical path in a zigzag manner.

In accordance with the normal-control processing method using the foregoing numerically-controlled cutting apparatus, although the Y-axis table allows a turning tool to perform a reciprocating fine motion at a high speed in the Y-axis direction since it is small and light and accordingly its inertia force is small, the X-axis table is not capable of allowing the turning tool to perform a reciprocating fine motion at a high speed in the X-axis direction since it is big and heavy and accordingly its inertia force is large.

Hence, when a lens for correcting heavy astigma is cut so as to provide a toric surface or the like having large undulation, the X-axis table cannot follow the number of rotation of a work used in a normal processing operation of a lens. Accordingly, the number of rotation of the work must be reduced to the extent to which the X-axis table can follow, thereby resulting in reduced productivity.

Since the X-axis table is required to move at least over a distance of the radius of a work, there is a limit for making the moving distance of the X-axis table smaller. Also, although an ultra-high-power motor may allow the X-axis table to perform a reciprocating motion at high speed, it is not possible because of large inertia force.

SUMMARY OF THE INVENTION

The present invention has been made in view of the above-mentioned limitations. Accordingly, it is an aspect of the present invention to provide an aspheric-surface processing method using a known numerically-controlled cutting apparatus, for quickly cutting a work having large undulation.

In order to solve the above-described problems, an aspheric-surface processing method according to the present invention, using a cuffing apparatus comprising at least one turning tool movable in the same direction as a rotating axis of a work and in a direction perpendicular to the rotating axis of the work. This method comprises moving the turning tool at a predetermined feed pitch in a fixed direction over at least a part of the work region extending from the center of the rotating axis of the work to a peripheral portion of the work in another direction perpendicular to the rotating axis of the work in order to process the work for forming an axis-asymmetric aspheric surface.

In accordance with the aspheric-surface processing method according to the present invention, since the turning tool moves at the predetermined feed pitch in the fixed direction so as to process the work, the turning tool cuts the work while depicting a simple helical path in a non-zigzag manner. That is, the turning tool always moves relative to the work in the fixed direction without performing a reciprocating motion in the other direction perpendicular to the rotational axis of the work. Thus, since an X-axis table of a numerically-controlled cutting apparatus moves in the fixed direction without causing the work to perform a reciprocation motion, the work can follow up a design path of the work even when the number of rotation of a work having large undulation is increased, thereby more quickly cutting the work than in accordance with a known processing method.

Also, there is provided the aspheric-surface processing method further including the step of controlling the cutting apparatus such that the center of the leading edge of the turning tool is positioned along a line being normal to a work surface of the work and extending through the work position of the work.

In addition, there is provided the aspheric-surface processing method further including the step of controlling the cutting apparatus such that the turning tool starts its processing operation in a state in which, in the other direction perpendicular to the rotational axis of the work, the distance between the center of rotation of the work and the leading edge of the turning tool or the distance between the periphery of the work and the leading edge of the turning tool is zero or almost zero.

Furthermore, there is provided an aspheric-surface forming method including the steps of: roughing a work rotatable about its rotating axis, for forming a configuration closely analogous to a desired configuration; and finishing the work for forming the desired configuration by processing the work in accordance with the asphericsurface processing method according to any one of Claims 1 to 3, subsequent to the roughing step.

In accordance with the aspheric-surface processing method and the aspheric-surface forming method according to the present invention, since a table whose inertia force is large can be controlled so as to move only in a fixed direction without performing a reciprocating motion, the table exhibits an excellent follow-up characteristic, thereby quickly cutting even a work having large undulation at high speed.

BRIEF DESCRIPTION OF THE DRAWINGS

In order to understand the invention and to see how it may be carried out in practice, illustrative, non-limiting embodiments will now be described, with reference to the accompanying drawings, in which.

DETAILED DESCRIPTION OF THE INVENTION

The present invention will now be described in detail by describing illustrative, non-limiting embodiments thereof with reference to the accompanying drawings.

Description of Cutting Apparatus

Figure 1:
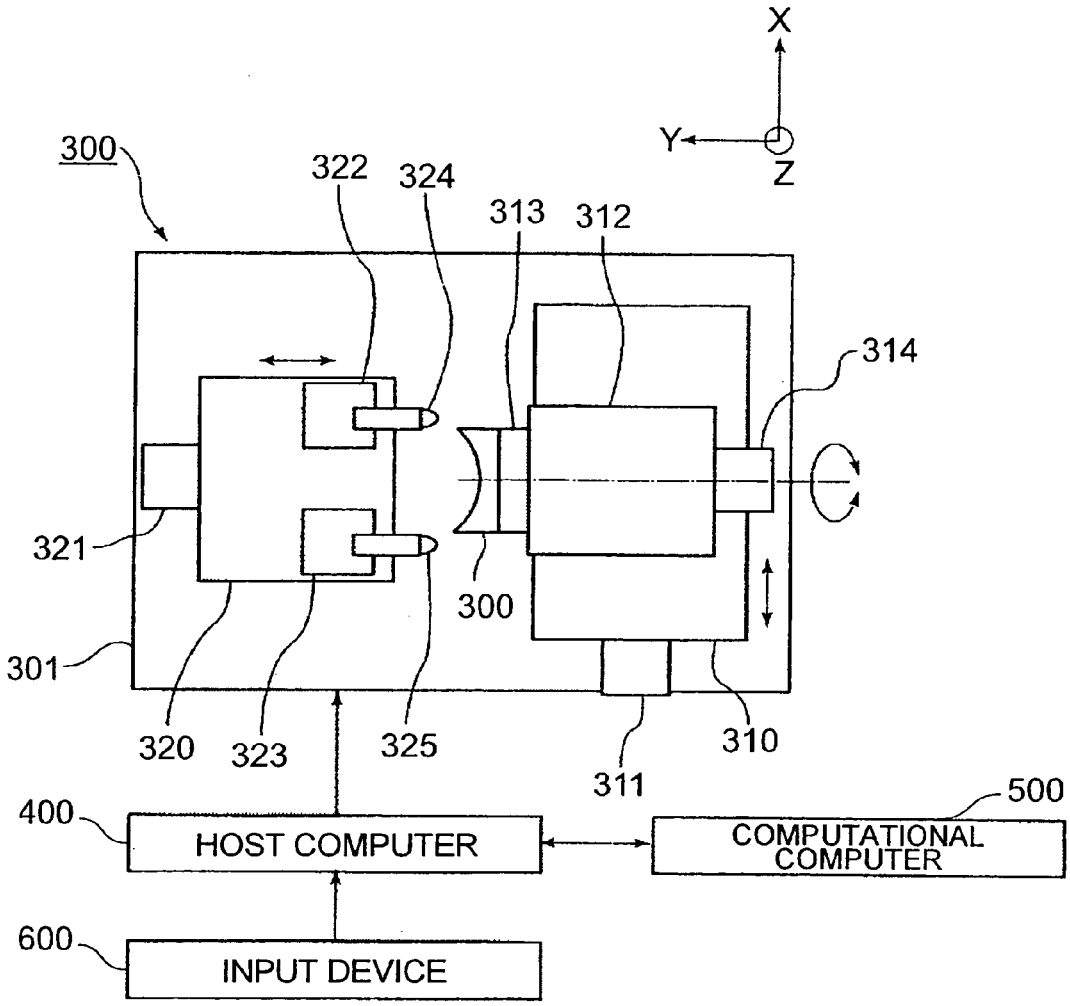
FIG. 1 illustrates the numerically-controlled cutting apparatus commonly used in aspheric-surface processing methods according to the an examplary, non-limiting embodiment of the present invention.

A numerically-controlled cutting apparatus (also, called an NC cutting apparatus) used in the aspheric-surface processing methods according to an illustrative, non-limiting embodiment of the present invention will now be described with reference to FIG. 1.

A numerically-controlled cutting apparatus 300 has an X-axis table 310 and a Y-axis table 320 mounted on a bed 301. The X-axis table 310 is driven by an X-axis driving motor 311 so as to perform a reciprocating motion in the X-axis direction. A position in the X-axis direction is detected by an encoder (not shown) incorporated into the X-axis driving motor 311. The X-axis table 310 has work-axis rotating means 312 firmly fixed thereon. The work-axis rotating means 312 has a work chuck 313 fixed thereto, and the work chuck 313 is driven to rotate about its main axis serving as a rotational axis and extending in the Y-axis direction perpendicular to the X-axis direction by a work-rotational-axis driving motor 314. A rotational position of the work chuck 313 is detected by an encoder (not shown) incorporated into the work-rotational-axis driving motor 314.

Figure 2:
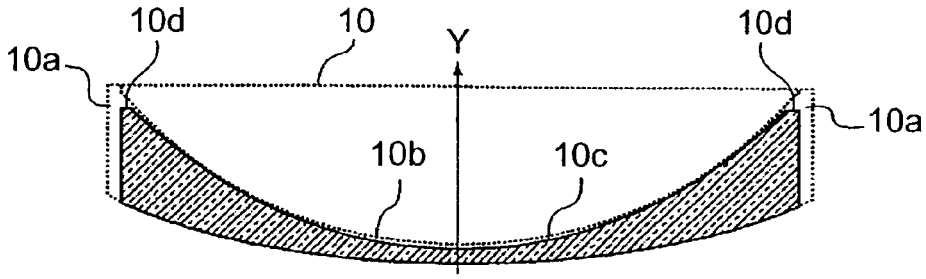
FIG. 2 is a sectional view of a lens serving as an examplary work.

The work chuck 313 has a work (an eyeglass lens) 10, shown in FIG. 2. This work 10 is to be processed and is fixed to a work chunk 313 with a block jig (not shown). The Y-axis table 320 is driven by a Y-axis driving motor 321 so as to perform a reciprocating motion in the Y-axis direction, that is, substantially in the horizontal direction, perpendicular to the X-axis table 310. A position in the Y-axis direction is detected by an encoder (not shown) incorporated into the Y-axis driving motor 321. The Y-axis table 320 has two units of first and second turning tool posts 322 and 323 firmly fixed thereon. The first turning tool post 322 has a roughing turning tool (cuffing turning tool) 324 firmly fixed thereto, and the second turning tool post 323 has a finishing turning tool 325 firmly fixed thereto. Thus, the numerically-controlled cutting apparatus 300 performs a cutting operation by switching between the roughing turning tool 324 and the finishing turning tool 325.

Meanwhile, the numerically-controlled cutting apparatus 300 may have a structure in which the work-axis rotating means 312 is firmly fixed, the Y-axis table 320 is placed on the X-axis table 310, and the X-axis table 310 allows the turning tools 324 and 325 to perform a reciprocating motion in the X-axis direction, in place of the structure in which the work-axis rotating means 312 performs a reciprocation motion in the X-axis direction in conjunction with the driven X-axis table 310. Also, instead of the encoders serving as position-detecting means for detecting positions along the X-axis and Y-axis directions, linear scales may be used.

This cutting apparatus cutting an eyeglass lens is numerically-controlled with the following illustrative, non-limiting control method. First, a rotational position of the work 10 is detected by the encoder incorporated into the work-rotational-axis driving motor 314 while the work 10 is rotating. Next, a position of the work 10 in the Y-axis direction relative to either of the turning tools 324 or 325, each serving as a rotational axis of the work 10, detected by the encoder incorporated into the Y-axis driving motor 321, is synchronized with a rotation of the work 10. Also a distance, in the X-axis direction detected by the encoder incorporated into the X-axis driving motor 311, between the rotating center of the work 10 and an edge of either of the turning tools 324 or 325 is synchronized with the rotation of the work 10.

As described above, the turning tool 324 or 325 is positioned at a work position by using the X-axis table 310, the Y-axis table 320, and the work-axis rotating means 312, collectively serving as a three-axes positioning mechanism. Thus, a configuration of the lens is generated in accordance with the design configuration of the lens by continuously positioning the coordinates of the center of the leading edge of either of the two turning tools so as to correspond to the work position.

Numerical data needed for the numerically-controlled cutting apparatus 300 to process the work (the eyeglass lens) 10 is computed by a computational computer 500 on the basis of processing-instruction data of the eyeglass lens inputted from an input device 600 serving as input means and is stored in a storage disposed in the numerically-controlled cutting apparatus 300 via a host computer 400 or transmitted in a processing operation from the host computer 400 to the numerically-controlled cutting apparatus 300.

Description of the Cutting Procedure

Referring now to FIG. 2, an illustrative, non-limiting embodimment of the cuffing procedure used by the cutting apparatus for forming an aspheric surface will be described with reference to FIG. 2. FIG. 2 is a sectional view of a lens serving as an example work 10. The cutting procedure includes an outside-diameter processing operation, a roughing operation for forming an approximate surface, a finishing operation, a chamfering operation, and so forth.

As shown in FIG. 2, the lens 10 (hereinafter, referred to as the semi-finish lens 10) serving as an example work has an unnecessary, slightly thick peripheral portion 10*a* having a finishing allowance (a cutting allowance and a grinding allowance), and, through the outside-diameter processing operation, the peripheral portion 10*a* is cut such that the outside diameter of the lens 10 is reduced to a predetermined one. The outside-diameter processing operation also serves so as to reduce the time needed for the roughing and finishing operations.

With the roughing operation for forming an approximate surface, the semi-finish lens 10 is quickly cut so as to have a predetermined approximate surface 10*b*. With the finishing operation, a desired lens surface 10*c* is accurately generated by cutting the approximate surface 10*b*. With the chamfering operation, a periphery 10*d* of the lens 10 is chamfered by the finishing turning tool since the periphery of the lens after the finishing operation is sharp and thus dangerous, in addition to being prone to chipping.

An examplary step of cutting the semi-finish lens 10 with the numerically-controlled cutting apparatus 300 shown in FIG. 1 will now be described. The semi-finish lens 10 firmly fixed to the block jig (not shown) of the work chuck 313 and is cut by the roughing turning tool 324 on the basis of outside-diameter processing-data for the semi-finish lens 10 so as to have a predetermined outside diameter. Next, the semi-finish lens 10 is cut by the roughing turning tool 324 on the basis of roughing data for processing the semi-finish lens 10 so as to have the approximate surface 10*b* having a surface configuration such as a freely curved surface, a toric surface, or a spherical surface, closely analogous to a desired lens-surface configuration and also having a surface roughness ("Rmax") equal to 100 μm or less.

Then, the semi-finish lens 10 is further cut by about 0.1 to 5.0 mm by the finishing turning tool 325 on the basis of finishing-data so as to complete the lens surface 10*c* in accordance with the processing-instruction data of an eyeglass lens 10 having a surface roughness Rmax in the range from about 1 to 10 μm. Subsequently, the periphery 10*d* is chamfered by the finishing turning tool 325 on the basis of chamfering data.

Description of Cutting Conditions

The examplary, non-limiting cutting conditions of the cutting apparatus are set in the following ranges: the numbers of rotations of a work are from 100 to 3000 rpm both for the roughing operation and the finishing operation, feed pitches are from 0.005 to 1.0 mm/rev. and 0.005 to 0.2 mm/rev. for the roughing operation and the finishing operation, respecitvely, and amounts of incision are 0.1 to 10.0 mm/pass and 0.05 to 3.0 mm/pass for the roughing operation and the finishing operation, respectively.

Although a majority of works are processed at a constant feed pitch, the feed pitch of some of the works may be varied midway through the processing operation. For example, the peripheral portion of a lens is prone to chipping regardless of the refractive index of the lens for an eye suffering from a degree of astigmatism equal to 2.00 D or higher. When such a lens is processed, the peripheral portion of the lens is processed at a small feed pitch P1, and the inner portion of the lens close to the center thereof is processed at a larger feed pitch PO (P1<P0). More particularly, P1 and PO are determined in the ranges from 0.01 to 0.07 mm/rev. and from 0.03 to 0.10 mm/rev., respectively. Also, the peripheral portion of a lens to be processed at the feed pitch P1 lies from the periphery of the lens to a closed line lying in the range from 5 to 15 mm from the periphery.

Figure 3A:
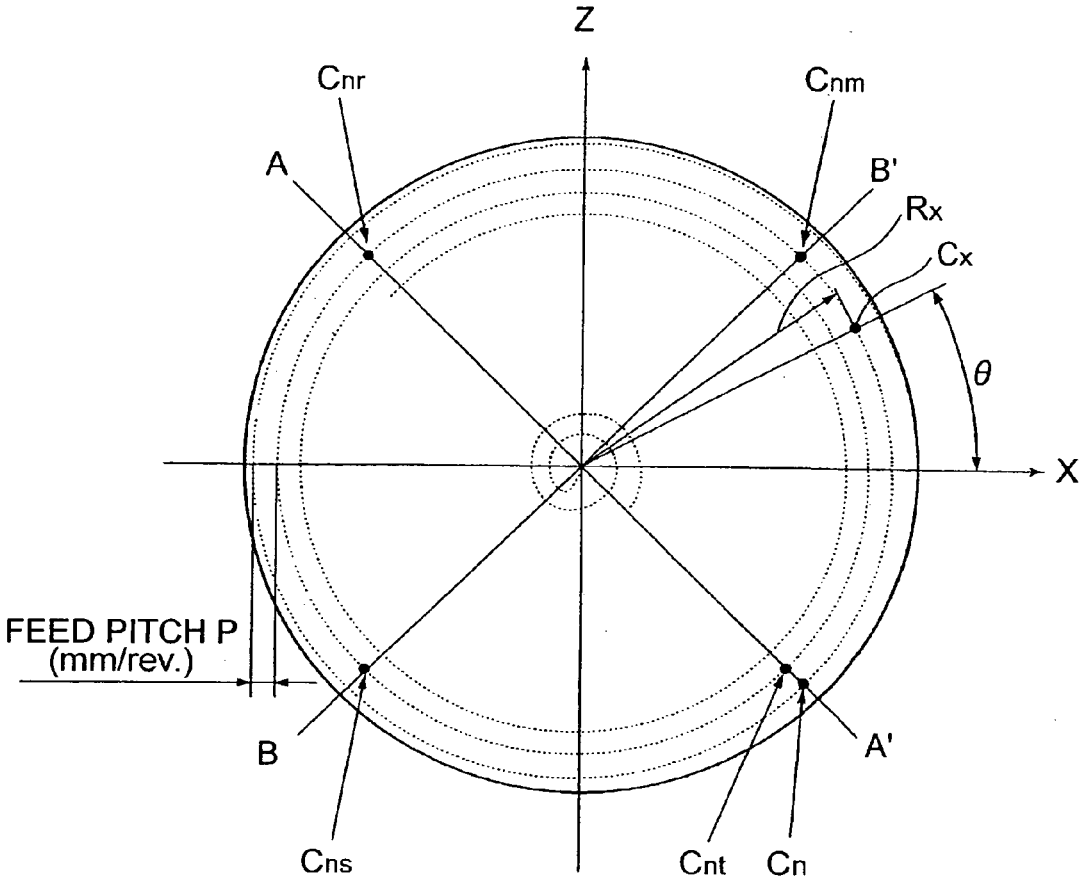
FIG. 3 is a schematic view illustrating a work surface of the lens to be processed in accordance with an aspheric-surface processing method according to an illustrative, non-limiting embodiment, wherein FIG. 3(*a*) is an elevation view of the lens, and FIG. 3(*b*) is a sectional view of the lens taken along the line B–B' indicated in FIG. 3(*a*).
Figure 3B:
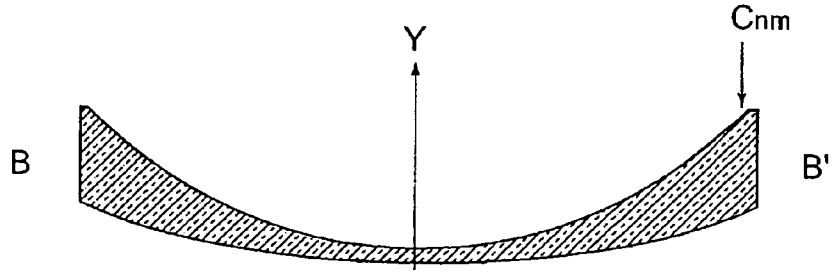
Figure 4:
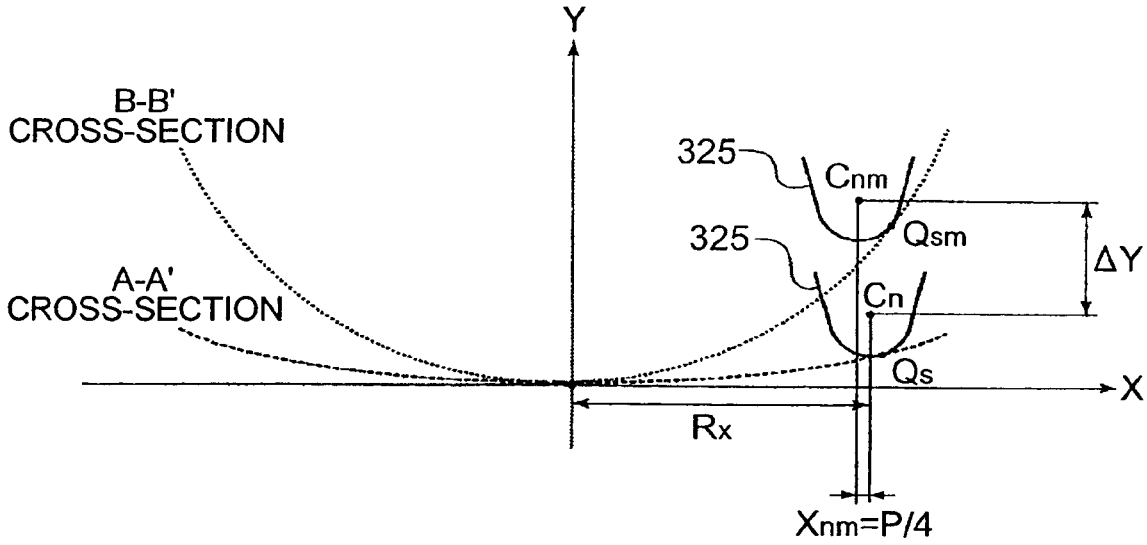
FIG. 4 is a conceptual view illustrating the aspheric-surface processing method according to this examplary embodiment of the present invention.
Figure 5:
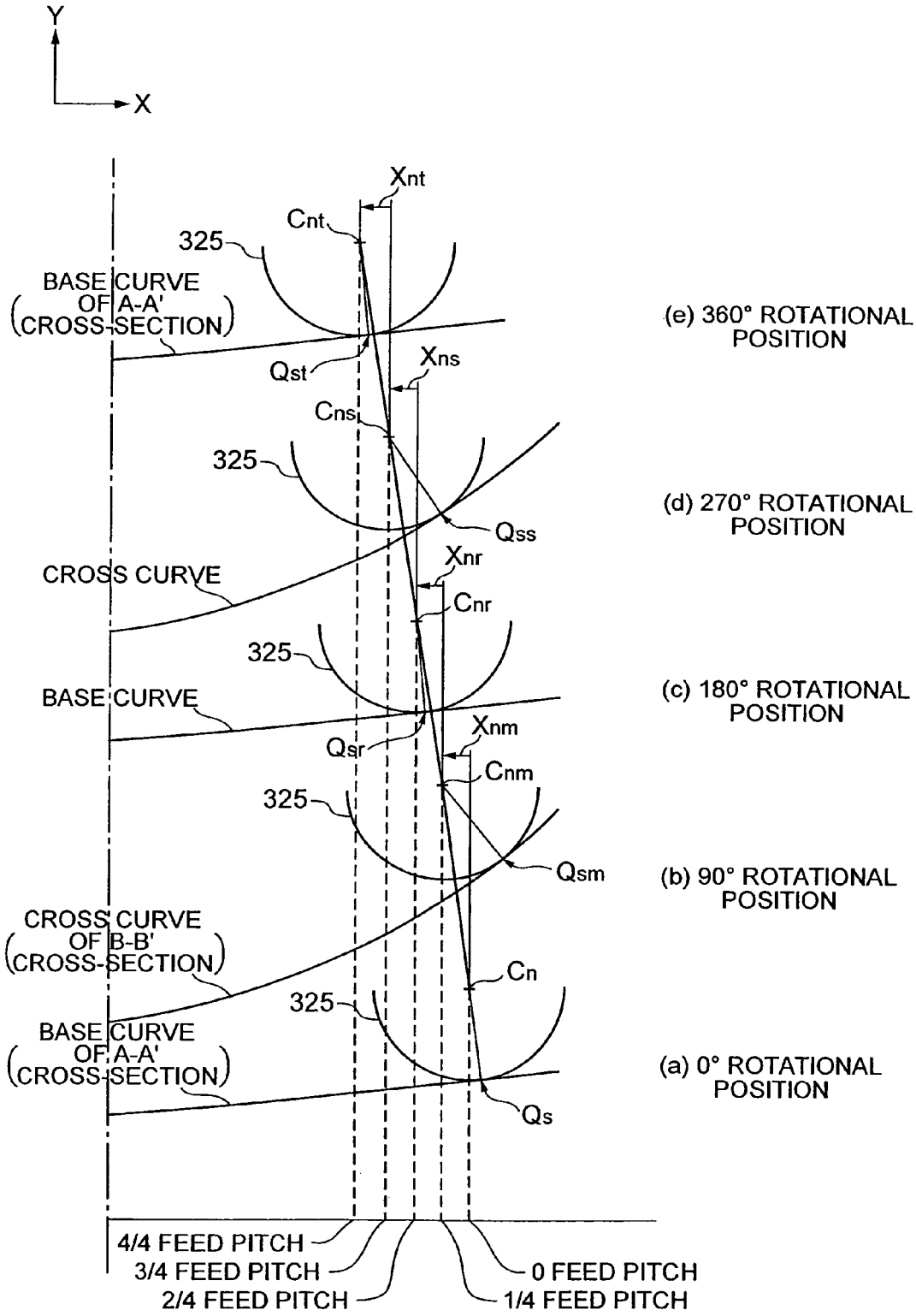
FIG. 5 is a conceptual view illustrating center positions of a turning tool in the X-axis direction in accordance with the aspheric-surface processing method according to this embodiment.

Next, referring now to FIGS. 3 to 5, an aspheric-surface processing method according to another non-limiting, examplary embodiment of the present invention will be described, taking an eyeglass lens (hereinafter, simply referred to as a lens) as an example of a work to be processed. FIG. 3 is a schematic view illustrating a work surface of the lens to be processed in accordance with the aspheric-surface processing method according to the first embodiment, wherein FIG. 3(*a*) is an elevation view of the lens, and FIG. 3(*b*) is a sectional view of the lens taken along the line B–B' indicated in FIG. 3(*a*). FIG. 4 is a conceptual view illustrating the aspheric-surface processing method according to this examplary embodiment. FIG. 5 is a conceptual view illustrating center positions of a turning tool in the X-axis direction in accordance with the aspheric-surface processing method according to this embodiment.

In accordance with the aspheric-surface processing method according to the embodiment, the turning tool 325 (since the same applies to the turning tool 324, hereinafter the turning tool 325 will represent either of the two turning tools) performs a cutting operation while the center of the leading edge of the turning tool is depicting a helical path, as shown in FIG. 3.

While each work position represented by a rotational angle and a distance from the center of rotation of the lens is predetermined in a known normal-control processing method, a helical shape depicted by the center of a leading edge of the turning tool 325 is predetermined in this aspheric-surface processing method. In other words, a helical path depicted by the turning tool 325 is determined by a predetermined feed pitch in a direction (the X-axis direction) perpendicular to the rotational axis of the work. The helical shape in this example is depicted when a distance Rx, shown in FIG. 4, from the center of rotation of the work to the center of the leading edge of the turning tool decreases continuously at a predetermined feed pitch, that is, when the turning tool moves from the periphery to the center of the lens.

Also, in accordance with this examplary aspheric-surface processing method, numerical data of coordinates Cx of the center of the leading edge (hereinafter, a leading edge is simply called a tip) of the turning tool is represented by three positions (θ, Rx, y): that is, a rotational position θ of the work, a distance Rx from the center of rotation of the work designed so as to continuously decrease at a predetermined feed pitch in the direction (the X-axis direction) perpendicular to the rotational axis of the work, and a position y at which the tip of the turning tool comes in contact with a work position of the work in the same direction as that along which the rotational axis (not shown) of the work extends.

Thus, a configuration of the lens is generated in accordance with the design configuration of the lens by continuously positioning the coordinates of the center of the tip of the turning tool. Meanwhile, the coordinates may be determined by using absolute values of each coordinate position or relative values with respect to the last coordinate position so as to provide numerical data for the processing operation.

As shown in FIGS. 3 to 5, for example, when the center of the tip of the turning tool 325 in the direction (the X-axis direction) perpendicular to the rotational axis of the work (hereinafter, called the center of the tip) lies on an arbitrary position Cn of a thinnest portion (the base curve of the A–A' cross-section), the center of the tip of the turning tool 325 in the Y-axis direction is positioned along a line being normal to the base curve and extending through a position Qs at which the tip of the turning tool 325 comes into contact with a work line of the lens lying along the A–A' cross-section when the turning tool 325 is freely moved in the Y-axis direction.

When the lens is rotated by 90 degrees, and the center of the tip of the turning tool 325 moves from the position Cn to an arbitrary position Cnm of a thickest portion (the cross curve of the B–B' cross-section), the center of the tip of the turning tool 325 in the Y-axis direction is positioned along a line being normal to the cross curve and extending a position Qsm at which the tip of the turning tool 325 comes into contact with a work line of the lens lying along the B–B' cross-section when the turning tool 325 is freely moved in the Y-axis direction.

When the lens is further rotated by 90 degrees, and the turning tool 325 moves from Cn to Cnm, the turning tool 325 moves towards the positive side of the Y-axis direction by ΔY while moving accurately relative to the work towards the center of the work in the X-axis direction by Xnm corresponding to a quarter of the feed pitch. In other words, the X-axis table 310 accurately moves the work outwards in the X-axis direction by Xnm corresponding to a quarter of the feed pitch.

When the lens is further rotated by 90 degrees, and the center of the tip of the turning tool 325 moves from the position Cnm to an arbitrary position Cnr on the curve of the thinnest portion, the turning tool 325 moves towards the negative side of the Y-axis direction while moving accurately relative to the work towards the center of the work in the X-axis direction by Xnr corresponding to a quarter of the feed pitch. In other words, the X-axis table 310 accurately moves the work outwards in the X-axis direction by Xnr corresponding to a quarter of the feed pitch.

In accordance with the aspheric-surface processing method according to this first embodiment, since the cutting apparatus is controlled such that the distance Rx, in the direction (the X-axis direction) perpendicular to the rotational axis of the work, between the center of rotation of the work 10 and the center of the tip of the turning tool deceases continuously at a predetermined feed pitch, the X-axis table 310 of the numerically-controlled cutting apparatus 300 moves the lens 10 only in a fixed direction without causing a reciprocating motion.

Meanwhile, when the number of rotation and the feed pitch of the work 10 are constant, the work 10 performs a uniform motion. As described above, since a path depicted on the lens 10 by the turning tool 325 exhibits a simple helical shape instead of a known zigzag shape, the turning tool 325 can follow up a design path of the work even when the number of rotation of the work having large undulation is increased. In other words, the turning tool 325 can perform a cutting operation at a higher cutting speed. As a result, the productivity of the cutting apparatus in accordance with the aspheric-surface processing method according to this illustrative embodiment is about one and a half times better than the productivity in accordance with the processing method by means of the known normal control.

Figure 6A:
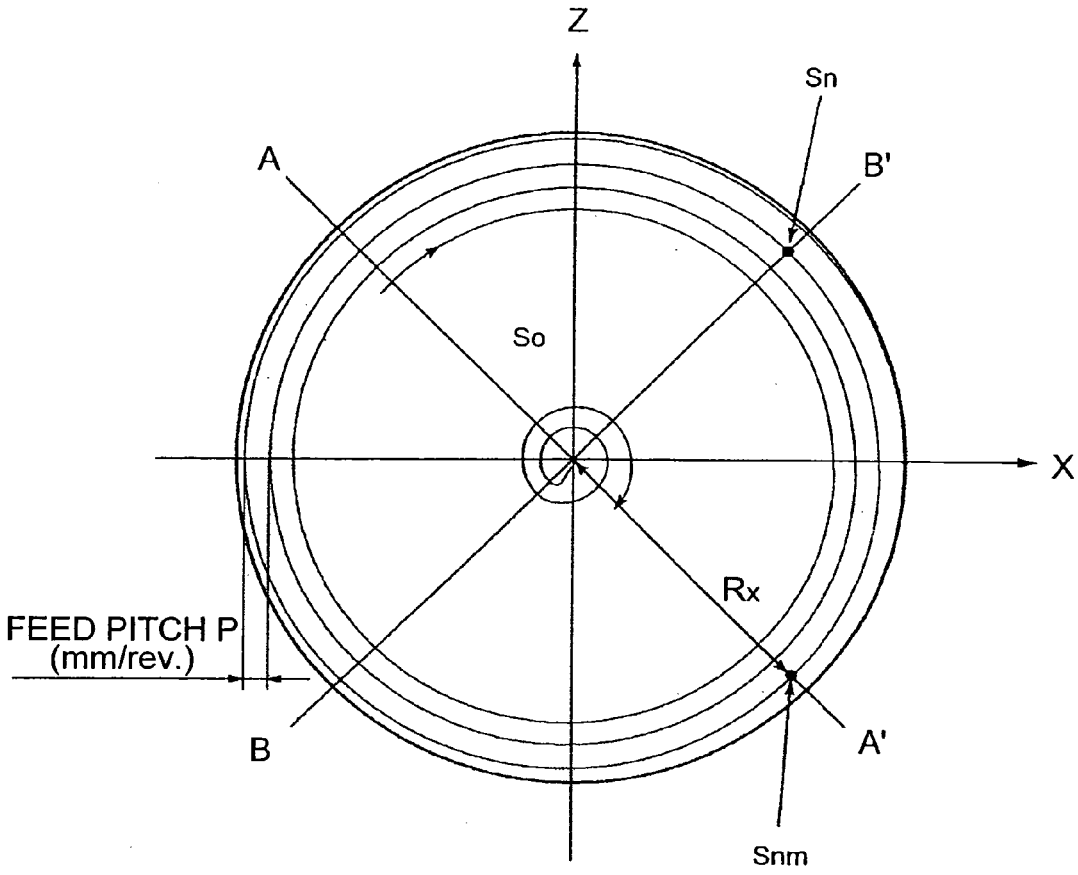
FIG. 6 is a schematic view illustrating a work surface of a lens to be processed in accordance with the aspheric-surface processing method according to a second, illustrative, non-limiting embodiment, wherein FIG. 6(*a*) is an elevation view of the lens, and FIG. 6(*b*) is a sectional view taken along the line B–B' indicated in FIG. 6(*a*).
Figure 6B:
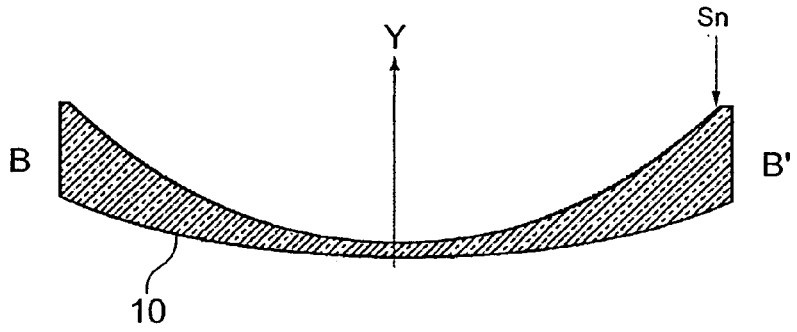
Figure 7:
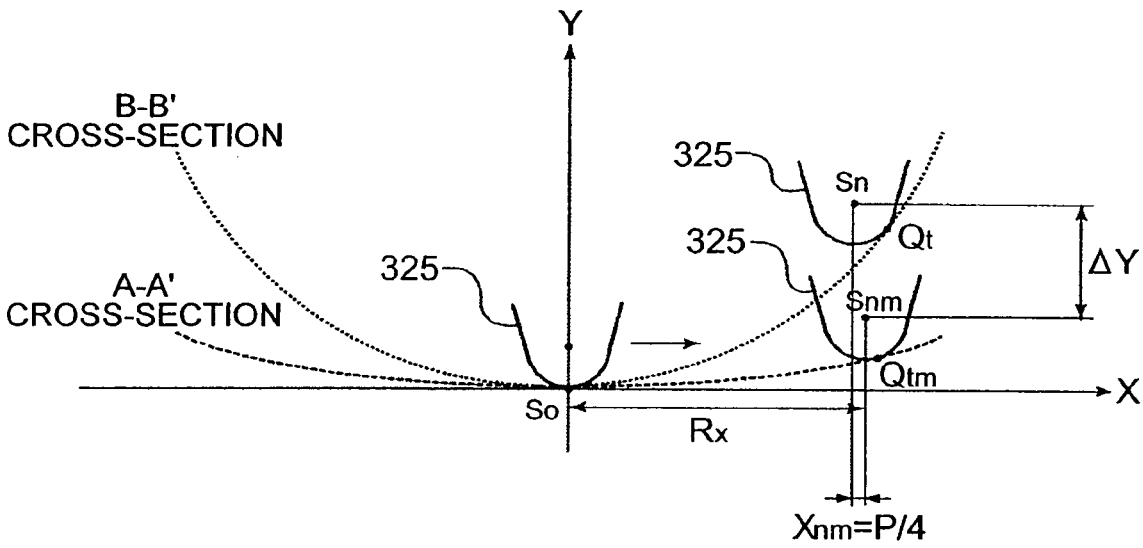
FIG. 7 is a conceptual view illustrating the aspheric-surface processing method according to the second embodiment.
Figure 8A:
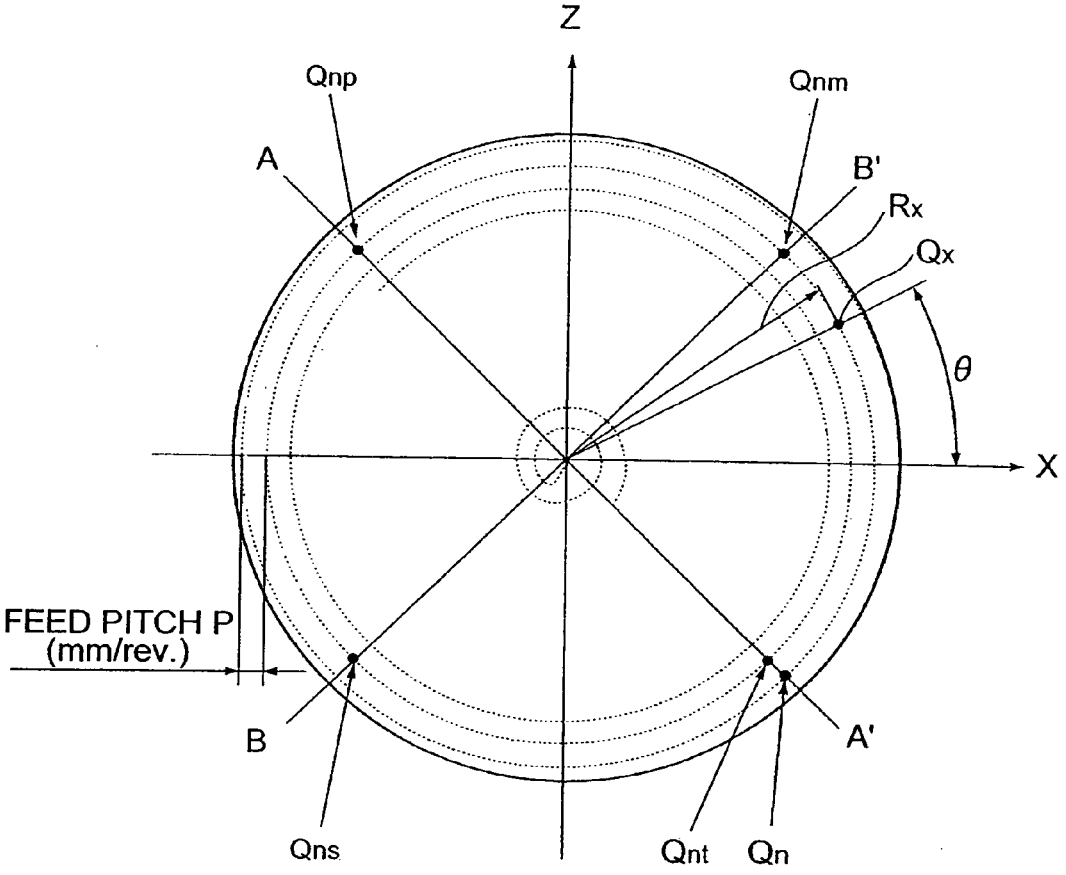
FIG. 8A PRIOR ART
FIG. 8 is a schematic view illustrating a work surface of a lens to be processed in accordance with a known normal-control processing method, wherein FIG. 8(*a*) is an elevation view of the lens, and FIG. 8(*b*) is a sectional view of the lens taken along the line B–B' indicated in FIG. 8(*a*).
Figure 8B:
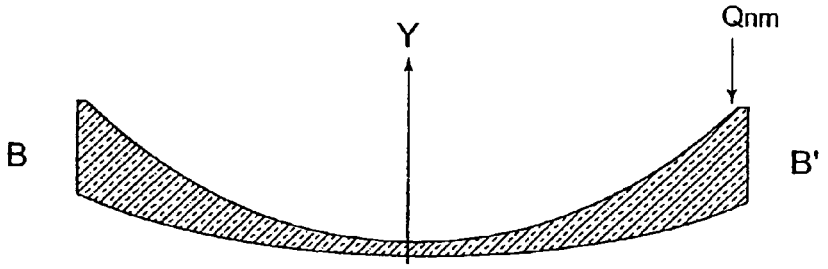
FIG. 8B PRIOR ART
Figure 9:
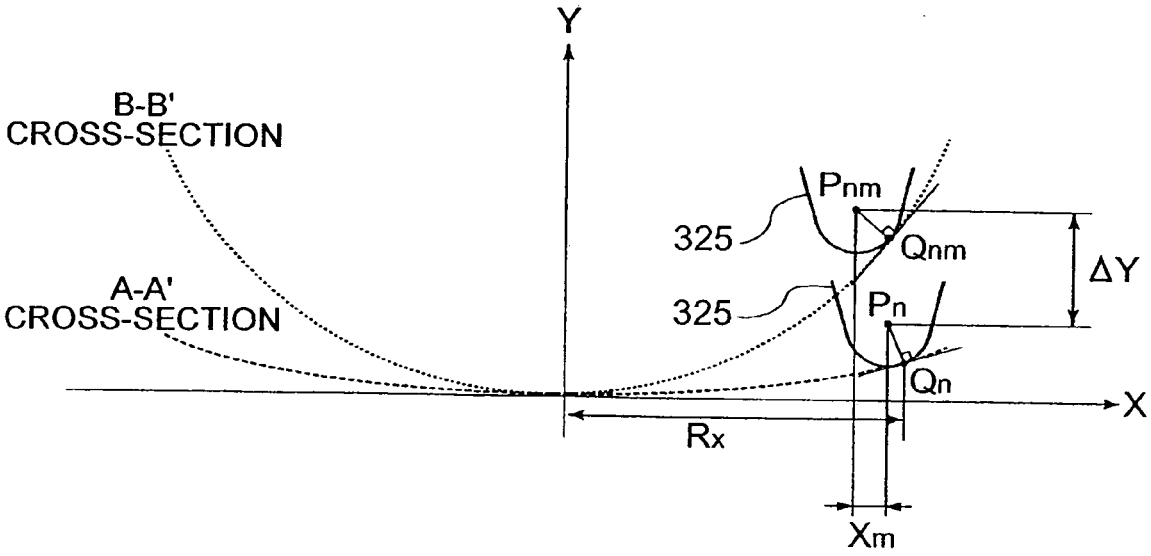
FIG. 9 PRIOR ART
FIG. 9 is a conceptual view illustrating the known normal-control processing method.
Figure 10:
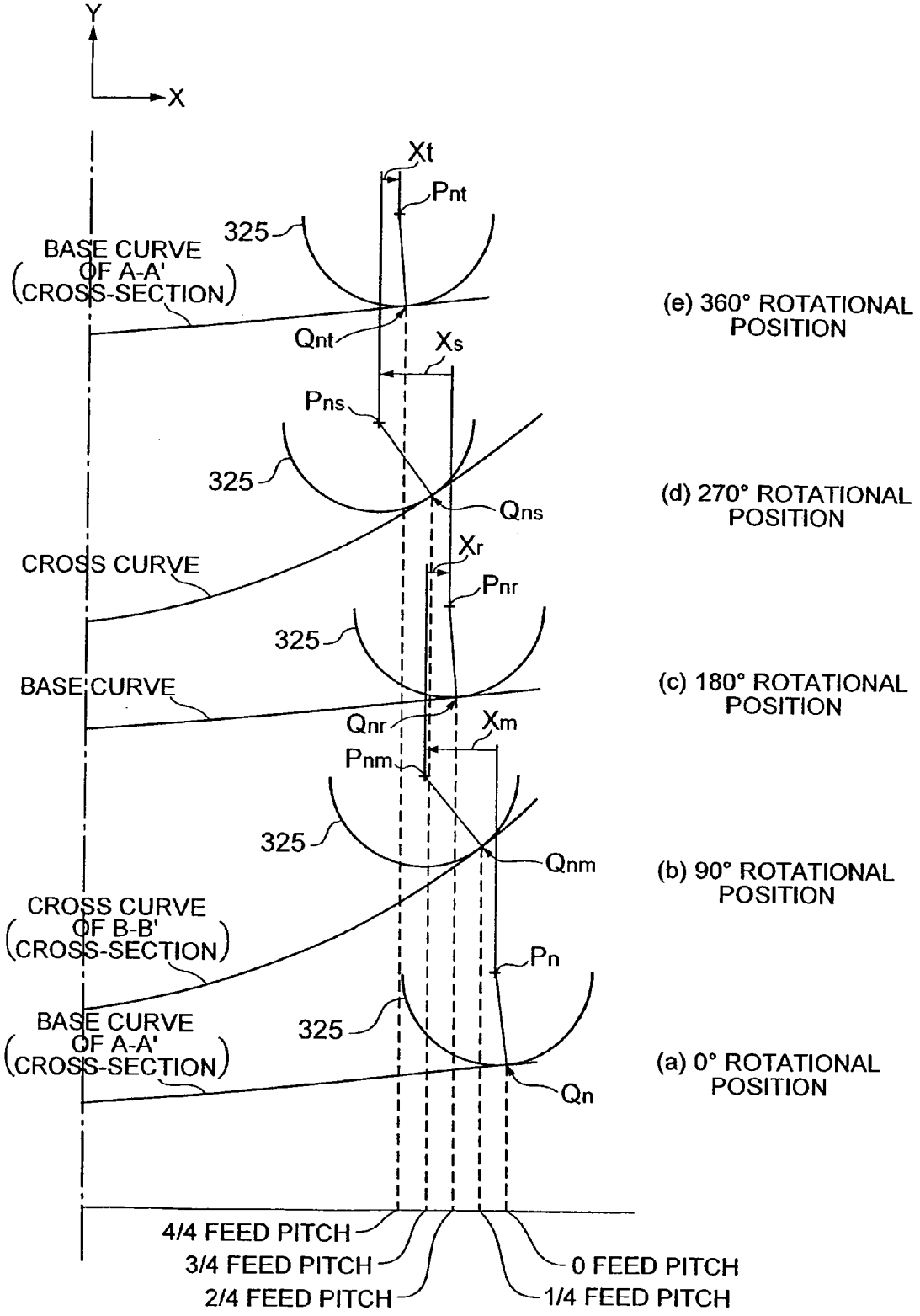
FIG. 10 PRIOR ART
FIG. 10 is a conceptual view illustrating center positions of a turning tool in the X-axis direction in accordance with the known normal-control processing method.

Referring now to FIGS. 6 and 7, an aspheric-surface processing method according to a second, illustrative, non-limiting embodiment of the present invention will be described. FIG. 6 is a schematic view illustrating a work surface of a lens to be processed in accordance with the aspheric-surface processing method according to the second embodiment, wherein FIG. 6(*a*) is an elevation view of the lens, and FIG. 6(*b*) is a sectional view taken along the line B–B' indicated in FIG. 6(*a*). FIG. 7 is a conceptual view illustrating the aspheric-surface processing method according to this second, illustrative embodiment of the present invention.

In accordance with the aspheric-surface processing method according to the second embodiment, the turning tool 325 performs a cutting operation while depicting a helical path as shown in FIG. 6. In this example, the cutting apparatus is controlled such that a distance Rx from the center of rotation of the work to the center of the leading edge of the turning tool increases at a predetermined feed pitch. That is, the turning tool 325 performs the cutting operation starting from a work position lying at or near the center of rotation of the work towards the periphery of the work. Cutting data for the cutting operation is generated along a helix extending from the center of rotation of the work towards the periphery of the work.

In the aspheric-surface processing method according to this second embodiment, a distance Rx from the center of rotation of the work, when the cutting apparatus is controlled such that the distance Rx increases at a predetermined feed pitch in the direction (the X-axis direction) perpendicular to the rotational axis of the work, is represented by a value in the X-axis direction in the numerical data of the coordinates of the center of the tip of the turning tool, in place of the distance Rx described in the previous embodiment.

As shown in FIGS. 6 and 7, in accordance with the aspheric-surface processing method according to the second embodiment, at the start of the cutting operation, the center of the tip of the turning tool 325 is positioned along a line, that is, the Y-axis (the main axis), being normal to the center of rotation of the work and extending through a work position So lying on the same, and the turning tool 325 starts its cutting operation from the position So lying at the center of rotation of the work. For example, when the center of the tip of the turning tool 325 lies at an arbitrary position Sn of the thickest portion (the cross curve of the B–B' cross-section), the center of the tip of the turning tool 325 in the Y-axis direction is positioned along a line being normal to the cross curve and extending a position Qt at which the tip of the turning tool 325 comes into contact with the work line of the lens lying along the B–B' cross-section when the turning tool 325 is freely moved in the Y-axis direction.

When the lens is rotated by 90 degrees, and the center of the tip of the turning tool 325 moves from the position Sn to an arbitrary position 5 nm of the thinnest portion (the base curve of the A–A' cross-section), a work position of the turning tool 325 lies at a position Qtm where the tip of the turning tool 325 comes into contact with the work line of the lens lying along the A–A' cross-section when the turning tool 325 is freely moved in the Y-axis direction, and the center of the tip of the turning tool 325 in the Y-axis direction is positioned along a line being normal to the base curve and extending through the position Qtm.

When the lens is further rotated by 90 degrees, and the turning tool 325 moves from Sn to 5 nm, the turning tool 325 moves towards the negative side of the Y-axis by ΔY while accurately moving towards the periphery of the lens in the X-axis direction by Xnm corresponding to a quarter of the feed pitch. In other words, the X-axis table 310 accurately moves the work towards the center of the lens in the X-axis direction by Xnm corresponding to a quarter of the feed pitch.

As described above, in accordance with the aspheric-surface processing method according to the second embodiment, the cutting apparatus is controlled such that the distance Rx, in the direction (the X-axis direction) perpendicular to the rotational axis of the work, between the center of rotation of the work and the center of the tip of the turning tool increases at a predetermined feed pitch, thereby causing a path depicted on the lens by the turning tool to form a simple helical shape instead of a known zigzag shape.

In the case where the turning tool starts its cutting operation from the periphery of a work, when the turning tool starts to come into contact with the peripheral surface of the high-speed rotating work having a high peripheral speed, it is difficult to suddenly place the turning tool on the peripheral surface of the work.

To solve the above problem, it is required that the turning tool is first disposed outward and away from the peripheral surface of the work so as not to come into contact with the work. Next, the turning tool is slowly moved towards the center of rotation of the work at a feed pitch of a normal cutting operation, and is placed on the peripheral surface of the work so as to start its cutting operation. Since the turning tool normally starts to move from a position about 5 mm outward and away from the peripheral surface of the work, the turning tool does not perform its cutting operation until it comes into contact with the work, thereby causing a part of its production time useless.

In accordance with the aspheric-surface processing method according to the second embodiment, since the turning tool starts its cutting operation from the center of rotation of the work, and hence the turning tool first comes into contact with the center of rotation of the work having zero or almost zero peripheral speed or a portion near the center of rotation of the work, the turning tool can be immediately placed on the work, whereby the turning tool completes the cutting operation when it moves only over a region necessary for the work to be cut.

As described above, since the turning tool starts its cutting operation from or near the center of rotation of the work, the turning tool completes its cutting operation by moving only over a region necessary for the work to be cut without reducing its moving speed, thereby further reducing the cutting operation time. The cutting operation time is less than that in the case where the turning tool starts its cuffing operation from the periphery of the work.

Also, the cutting data for the processing operation is sufficient as long as it associates only with the work surface of the work, thereby reducing an amount of the cutting data.

Meanwhile, in accordance with the aspheric-surface processing method for performing a cutting operation starting from the center of rotation of the work, since the turning tool starts its cutting operation from the center of rotation of the work having zero or almost zero peripheral speed, this processing method is preferably applied to the finishing operation in a processing procedure, which will be described later. When asize of the cut (an amount of the incision) is about 0.1 to 5.0 mm, the cutting operation can be started by directly placing the turning tool on the center of the rotation of the work.

Also, at the time of starting the cutting operation, the center of the curved portion of the tip of the turning tool 325 is positioned along the Y-axis extending through the start position So of the path of the turning tool, which is the center of rotation of the work represented by the Y-axis (the main axis), and a position of the turning tool 325 in the Y-axis direction is controlled so that the turning tool 325 processes a work position of a lens at which the turning tool 325 abuts against the lens in this instance. Thus, a configuration of the lens is generated in accordance with the design configuration of the lens by continuously positioning the coordinates of the center of the leading edge of the turning tool along the path of the helix extending from the center of the rotation to the periphery of the work. Meanwhile, the coordinates may be determined by using absolute values of each coordinate position or relative values with respect to the last coordinate position so as to provide numerical data for the processing operation.

As described above, a work can be processed more quickly in accordance with the aspheric-surface processing method according to the second embodiment than in accordance with the first embodiment.

Also, the entire lens may be processed in accordance with the aspheric-surface processing method according to the present invention. In addition, it is possible that a part of a lens is processed in accordance with the aspheric-surface processing method according to the present invention, and another part of the lens is processed in accordance with the normal-control processing method. In particular, when a lens having a sloped portion such as a prism near the center of a work is processed according to the present invention, the turning tool may interfere with the prism when processing around the center of the work. Accordingly, cutting a part of the work in accordance with the known normal-control processing method is effective.

Meanwhile, the aspheric-surface processing method according to the present invention is especially effective for processing the peripheral portion of a lens having a high peripheral speed. Since the lens has a small undulation near the central part thereof, even when the known normal-control processing method is applied to a processing of the central part of the lens, its productivity does not significantly decrease. Thus, it is possible that the aspheric-surface processing method according to the present invention is applied to the processing of the peripheral portion of a lens while the normal-control processing method is applied to the processing of the central part of the lens.

Furthermore, the aspheric-surface processing method according to the present invention is applicable not only to forming a final lens-surface configuration of an eyeglass lens in accordance with processing-instruction data of the eyeglass lens, but also to processing operations such as the outside-diameter processing operation for cutting the outside diameter of the lens so as to reduce the outside diameter, the roughing operation for forming a surface configuration such as a freely curved surface, a toric surface, or a spherical surface, closely analogous to the final lens-surface configuration, and the chamfering operation for chamfering a sharp periphery of the lens.

Also, the aspheric-surface processing method according to the present invention can deal with works such as lenses other than an eyeglass lens and a mold for cast-molding a lens. In addition, the processing method can deal with a convex work surface in addition to a concave work surface.

The above and other features of the invention including various and novel details of the process and construction of the parts has been particularly described with reference to the accompanying drawings and pointed out in the claims. It will be understood that the particular process and construction of parts embodying the invention is shown by way of illustration only and not as a limitation of the invention. The principles and features of this invention may be employed in varied and numerous embodiments without departing from the scope of the invention.

The invention claimed is:

1. An aspheric-surface processing method using a cutting apparatus comprising at least one turning tool movable in the same direction as a rotating axis of a work and in a direction perpendicular to the rotating axis of the work, the method comprising:

controlling the cutting apparatus such that a center of leading edge of the turning tool is positioned along a line being normal to a work surface of the work and extending through a work position of the work;

moving the turning tool at a predetermined constant feed pitch in a fixed direction over at least a part of a region of the work extending from a center of the rotating axis of the work to a peripheral portion of the work; and moving the turning tool in another direction perpendicular to the rotating axis of the work in order to process the work for forming an axis-asymmetric aspheric surface.

2. The aspheric-surface processing method according to claim 1, further comprising controlling such that the turning tool starts the processing operation in a state in which, in the another direction perpendicular to the rotational axis of the work, the distance between the center of the rotation of the work and the leading edge of the turning tool or the distance between the periphery of the work and the leading edge of the turning tool is near zero.

3. The aspheric-surface processing method according to claim 1, further comprising controlling the cutting apparatus wherein the turning tool starts the processing operation in a state in which, in the another direction perpendicular to the rotational axis of the work, the distance between the center of rotation of the work and the leading edge of the turning tool or the distance between the periphery of the work and the leading edge of the turning tool is almost zero.

4. The aspheric-surface processing method according to claim 1, wherein the turning tool is moved at the predetermined constant feed pitch in the fixed direction over a majority of the region of the work, said region extending from a center of the rotating axis of the work to a peripheral portion of the work.

5. The aspheric-surface processing method according to claim 1, wherein the turning tool is moved at the predetermined constant feed pitch in the fixed direction over a majority of the work.

* * * * *